US009380859B2

(12) United States Patent
Pender

(10) Patent No.: US 9,380,859 B2
(45) **Date of Patent: *Jul. 5, 2016**

(54) CLEANING APPARATUS

(71) Applicant: David Pender, St. Louis, MO (US)

(72) Inventor: David Pender, St. Louis, MO (US)

(73) Assignee: David Pender, St. Louis, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/523,265

(22) Filed: Oct. 24, 2014

(65) Prior Publication Data

US 2015/0296972 A1 Oct. 22, 2015

Related U.S. Application Data

(63) Continuation-in-part of application No. 14/256,340, filed on Apr. 18, 2014, now Pat. No. 8,332,831.

(60) Provisional application No. 61/814,527, filed on Apr. 22, 2013.

(51) Int. Cl.
*A46B 13/04* (2006.01)
*A46B 9/02* (2006.01)

(52) U.S. Cl.
CPC ..... *A46B 13/04* (2013.01); *A46B 9/026* (2013.01); *A46B 2200/30* (2013.01); *A46B 2200/304* (2013.01)

(58) Field of Classification Search
CPC ..... A46B 13/04
See application file for complete search history.

(56) References Cited

U.S. PATENT DOCUMENTS

| | | | | | |
|---|---|---|---|---|---|
| 3,293,680 | A | * | 12/1966 | Wilson et al. | 15/104.095 |
| 4,399,578 | A | * | 8/1983 | Bordeaux | 15/97.1 |
| 4,561,141 | A | | 12/1985 | Trisolini | |
| 4,875,246 | A | | 10/1989 | MacGregor | |
| 5,146,642 | A | * | 9/1992 | Mank et al. | 15/24 |
| 5,423,102 | A | * | 6/1995 | Madison | 15/22.2 |
| 5,511,269 | A | * | 4/1996 | Watson | 15/22.1 |
| 5,649,334 | A | * | 7/1997 | Henriquez et al. | 15/29 |
| 5,881,418 | A | * | 3/1999 | Enoch | 15/101 |
| 5,960,503 | A | * | 10/1999 | Del Pozo Y Mattei | 15/29 |
| 5,964,003 | A | * | 10/1999 | Rogers | 15/98 |
| 7,331,077 | B1 | * | 2/2008 | Henry | 15/23 |
| 2002/0066148 | A1 | | 6/2002 | Castellon | |
| 2004/0083567 | A1 | * | 5/2004 | Lies | 15/28 |
| 2005/0022324 | A1 | * | 2/2005 | Elster | 15/24 |
| 2005/0278880 | A1 | * | 12/2005 | Pieroni et al. | 15/97.1 |
| 2007/0209138 | A1 | | 9/2007 | Tran et al. | |
| 2012/0246848 | A1 | | 10/2012 | Hruby | |

OTHER PUBLICATIONS

International Search Report, International Patent Application No. PCT/US14/34635, mailed Aug. 28, 2014, 12 pages.

* cited by examiner

*Primary Examiner* — Randall Chin
(74) *Attorney, Agent, or Firm* — Lewis Rice LLC

(57) ABSTRACT

A cleaner assembly includes a main body having a first end with a handle portion and a second end with a removable cleaner head; a pneumatic motor contained with in said main body; an actuator operatively associated with said motor; a rotational shaft operatively associated with said motor and with a rotational cleaner head support; and a cleaner head removably attached to said rotational shaft.

5 Claims, 16 Drawing Sheets

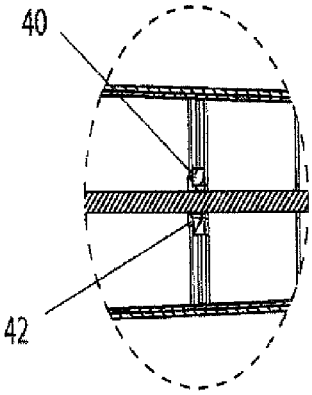
FIG. 8
FIG. 6
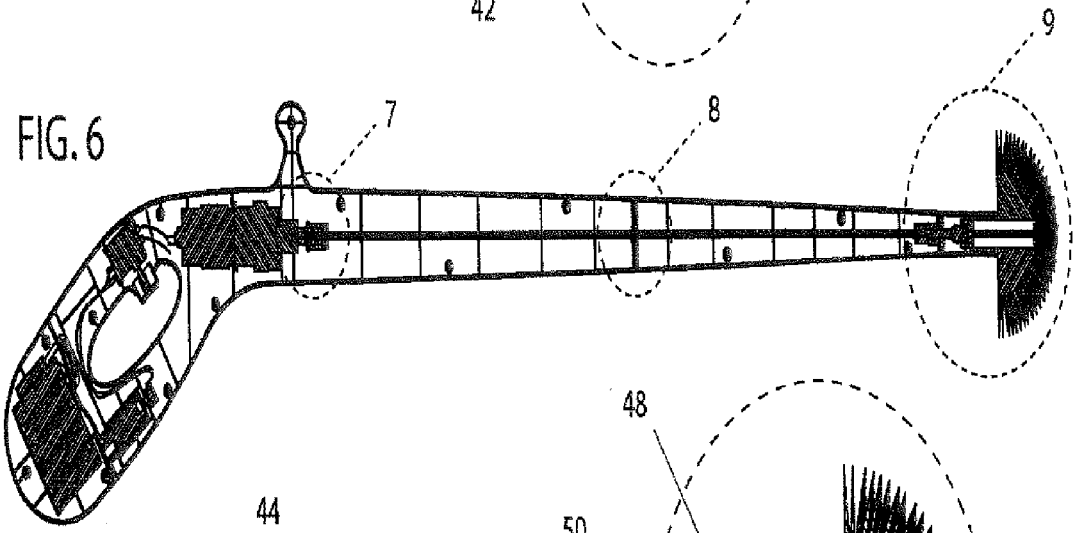
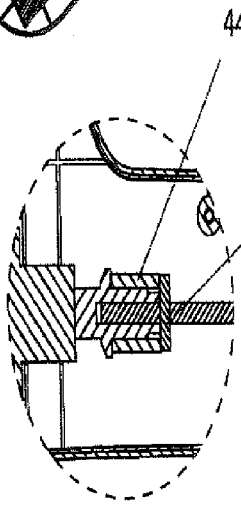
FIG. 7
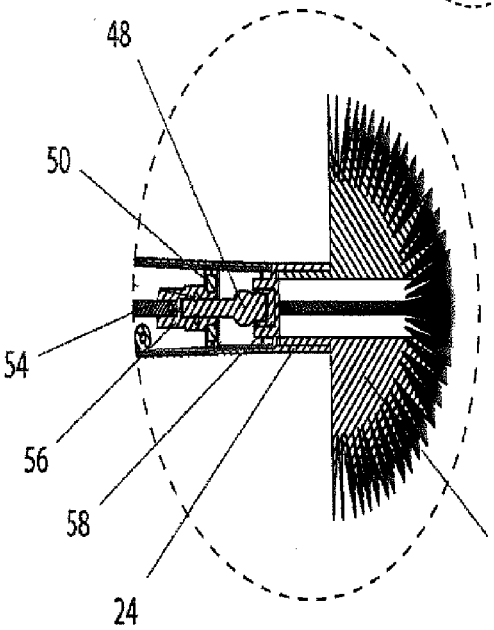
FIG. 9

CLEANING APPARATUS

CROSS REFERENCE TO RELATED APPLICATIONS

This application is a continuation-in-part of U.S. non-provisional patent application Ser. No. 14/256,340, filed Apr. 18, 2014 which claims benefit to U.S. Provisional Patent Application Ser. No. 61/814,527 filed Apr. 22, 2013 the disclosures of which are incorporated herein by reference in its entirety.

BACKGROUND OF THE INVENTION

1. Field of the Invention

The present invention generally relates to a cleaning apparatus, and more particularly relates to a cleaning apparatus driven by a power tool.

2. Description of Related Art

Various cleaning apparatus are known in the industry such as a mop, a rag, a sponge, a string mop, a sponge mop, a squeegee etc. These devices are driven manually and thus require a lot of human effort during operations. Sometimes, the contaminants are so thick that it becomes impossible for a human to remove them through manual operated cleaning apparatus. Also various other cleaning apparatus are available in the market that is driven by motors. However, these devices are bulky and have limited applications. Therefore, there is a need of a cleaning apparatus that is power driven and is portable to meet various applications.

SUMMARY OF THE INVENTION

In accordance with the teachings of the present invention, a cleaning apparatus driven by a power tool is provided.

An object of the present invention is to provide a portable brush and a power tool to drive the portable brush.

Another object of the present invention is to provide a portable brush, a power tool to drive the portable brush, a liquid dispenser attached to the handle of the portable brush and a liquid reservoir attached to the liquid dispenser.

Another object of the present invention is to provide a cleaning apparatus to clean automobiles, boats, fences, drains, gutter, walls, floors, roof etc.

In one embodiment, the present invention is a cleaner assembly comprising;

a main body having a first end with a handle portion and a second end with a removable cleaner head;

a pneumatic motor contained within said Main body;

an actuator operatively associated with said motor;

a rotational shaft operatively associated with said motor and with a rotational cleaner head support; and a cleaner head removably attached to said rotational shaft.

In one embodiment, the shaft includes a middle bearing and middle bearing spacer positioned between said motor and said cleaner head support along the length of said shaft.

In one embodiment, the shaft is a shaft assembly that includes two or more shafts acting in concert.

In one embodiment, the cleaner assembly includes a solution delivery assembly including a water inlet and a solution reservoir configured to deliver liquid through a dispenser shaft and exit through a dispenser shaft outlet.

In one embodiment, the cleaner assembly includes a solution delivery assembly including a water inlet having a water inlet control valve.

In one embodiment, the cleaner assembly includes a solution reservoir assembly having a solution reservoir control valve.

In one embodiment, the cleaner assembly includes each of a solution delivery assembly including a water inlet having a water inlet control valve and a solution reservoir assembly having a solution reservoir control valve.

BRIEF DESCRIPTION OF THE SEVERAL VIEWS OF THE DRAWINGS

FIG. 6 is a cross section side view of one embodiment according to the present invention.

FIG. 7 is a cross-section detail view from FIG. 6.

FIG. 8 is a cross section detail view from FIG. 6.

FIG. 9 is a cross-section detail view of cleaner head and mechanism from FIG. 6.

DETAILED DESCRIPTION OF THE PREFERRED EMBODIMENT

Figure 1:
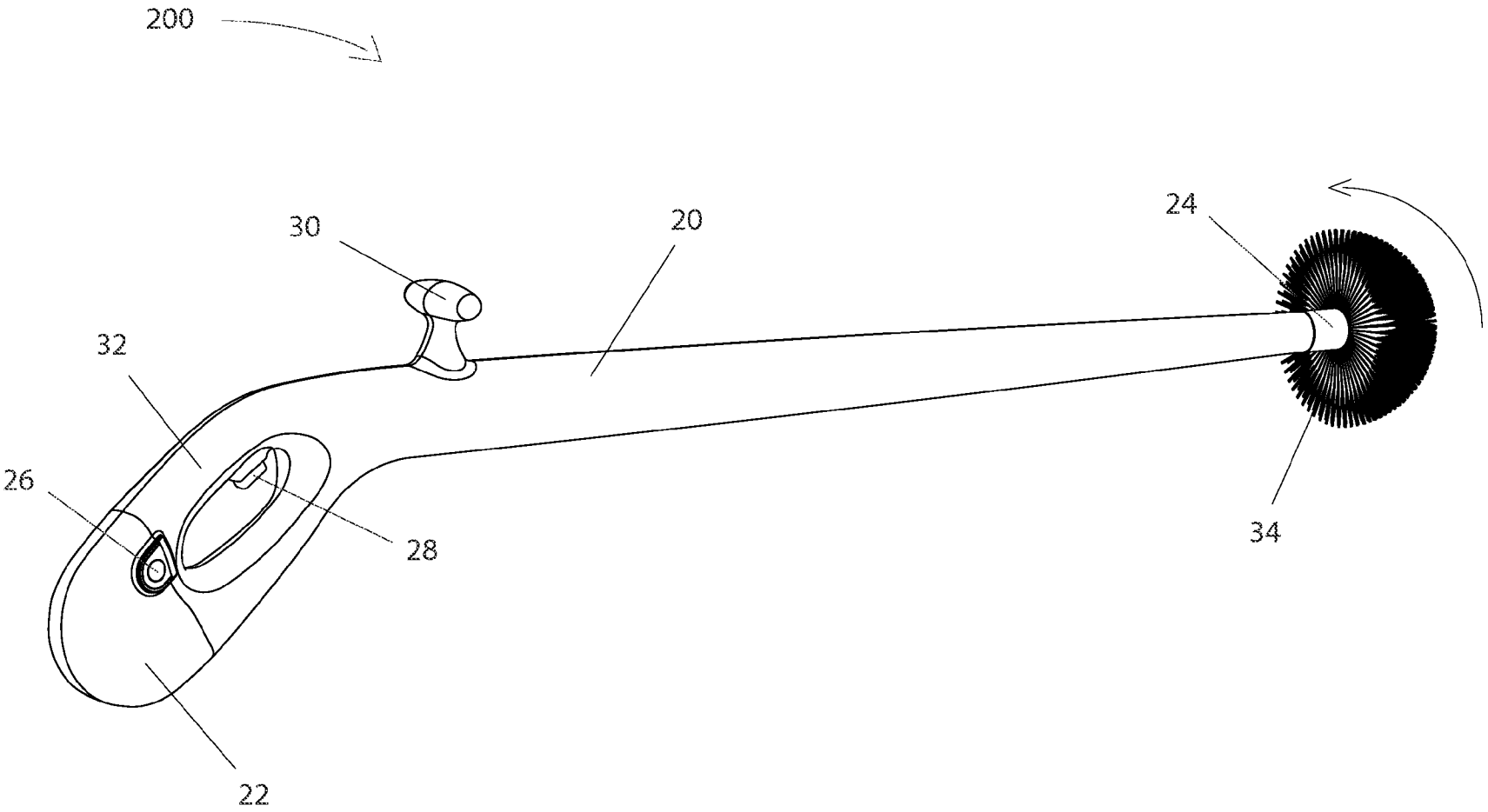
FIG. 1 is a perspective view of one embodiment according to the present invention.
Figure 2:
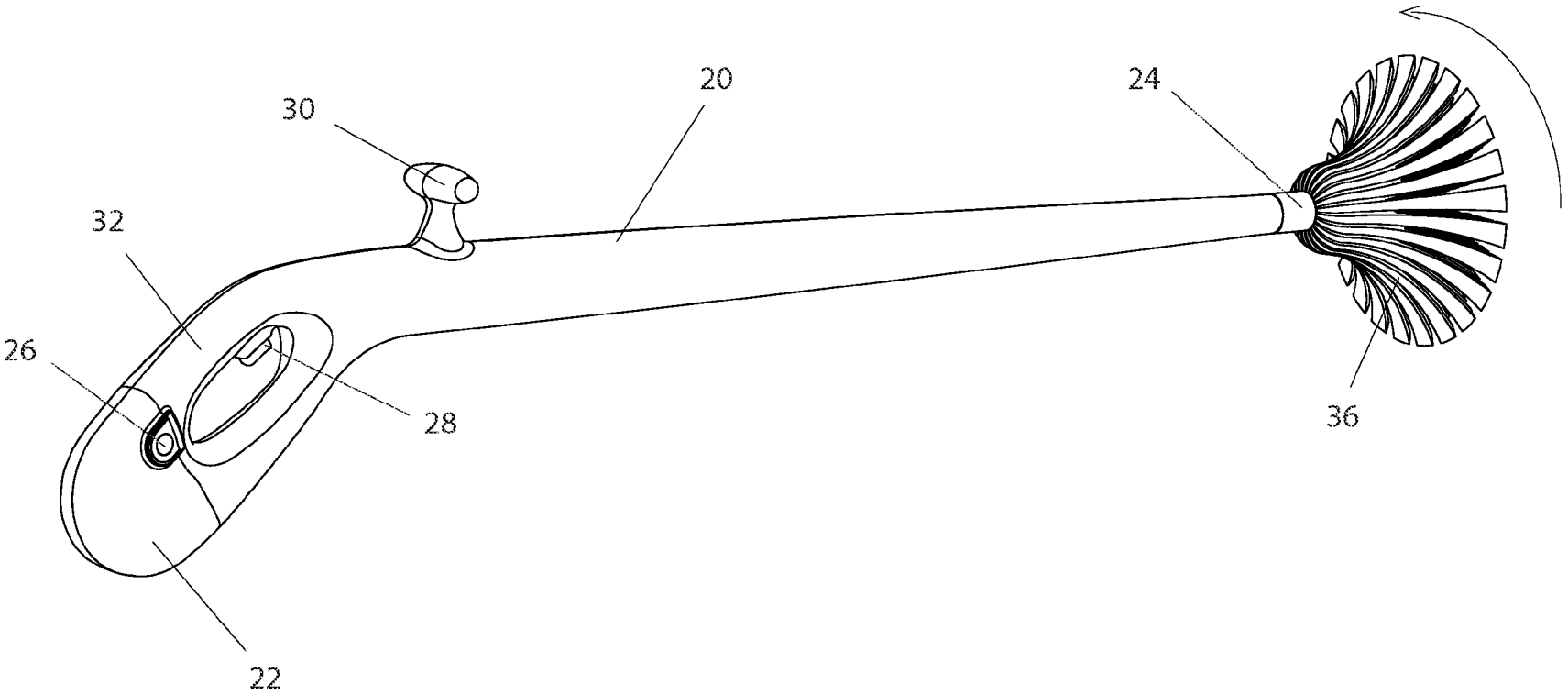
FIG. 2 is a perspective view of one embodiment according to the present invention demonstrating a particular cleaner head.
Figure 3:
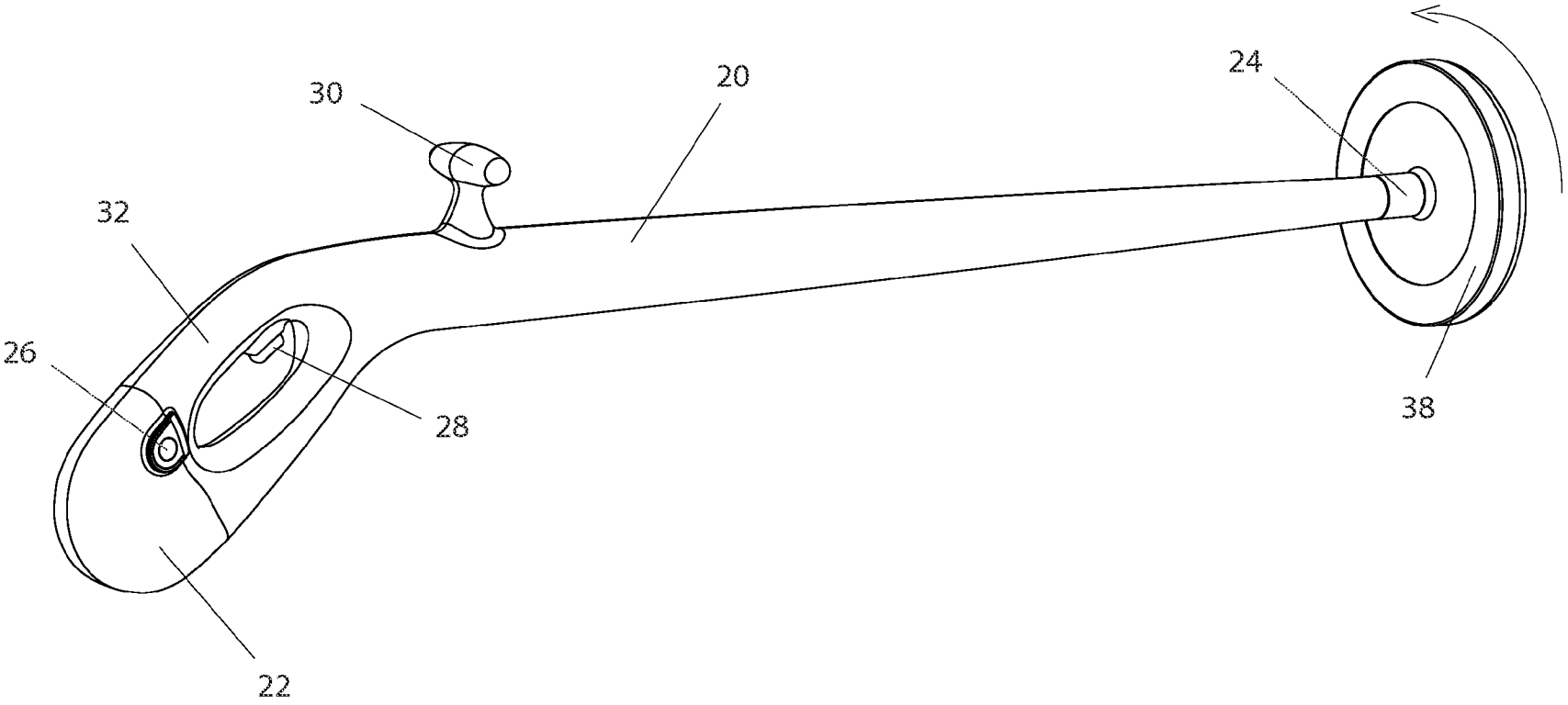
FIG. 3 is a perspective view of one embodiment to the present invention demonstrating a particular cleaner head.
Figure 4:
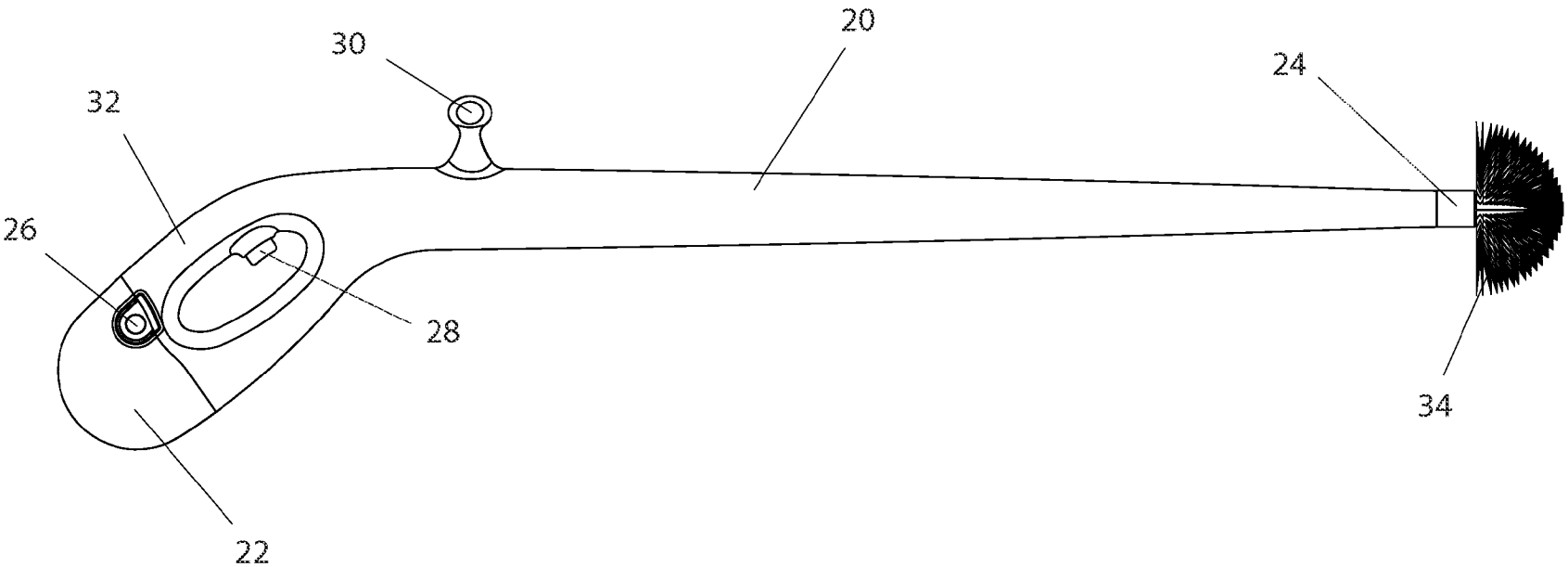
FIG. 4 is a side view of one embodiment of the present invention.
Figure 5:
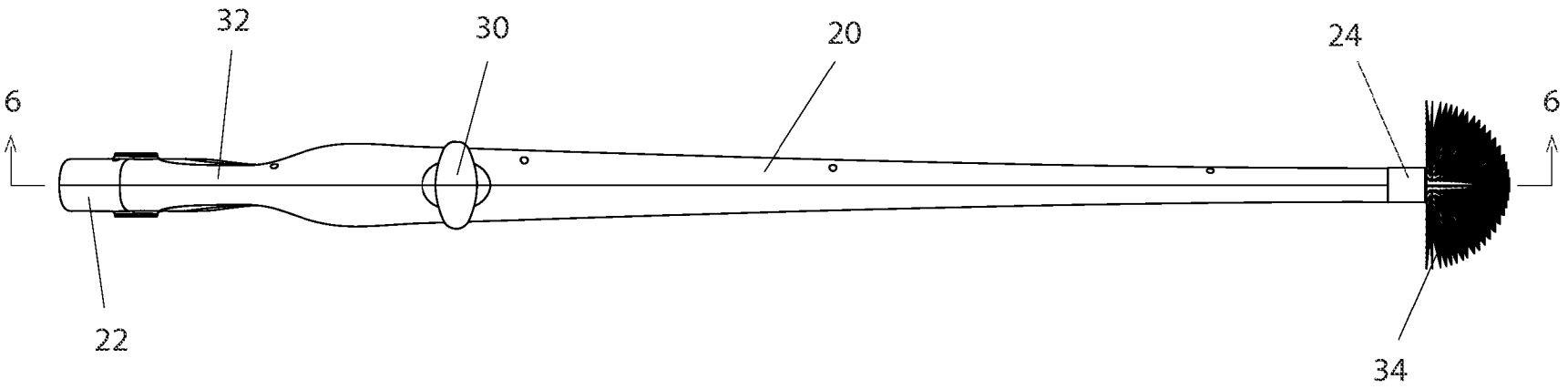
FIG. 5 is a side view of an embodiment of the present invention.
Figure 10:
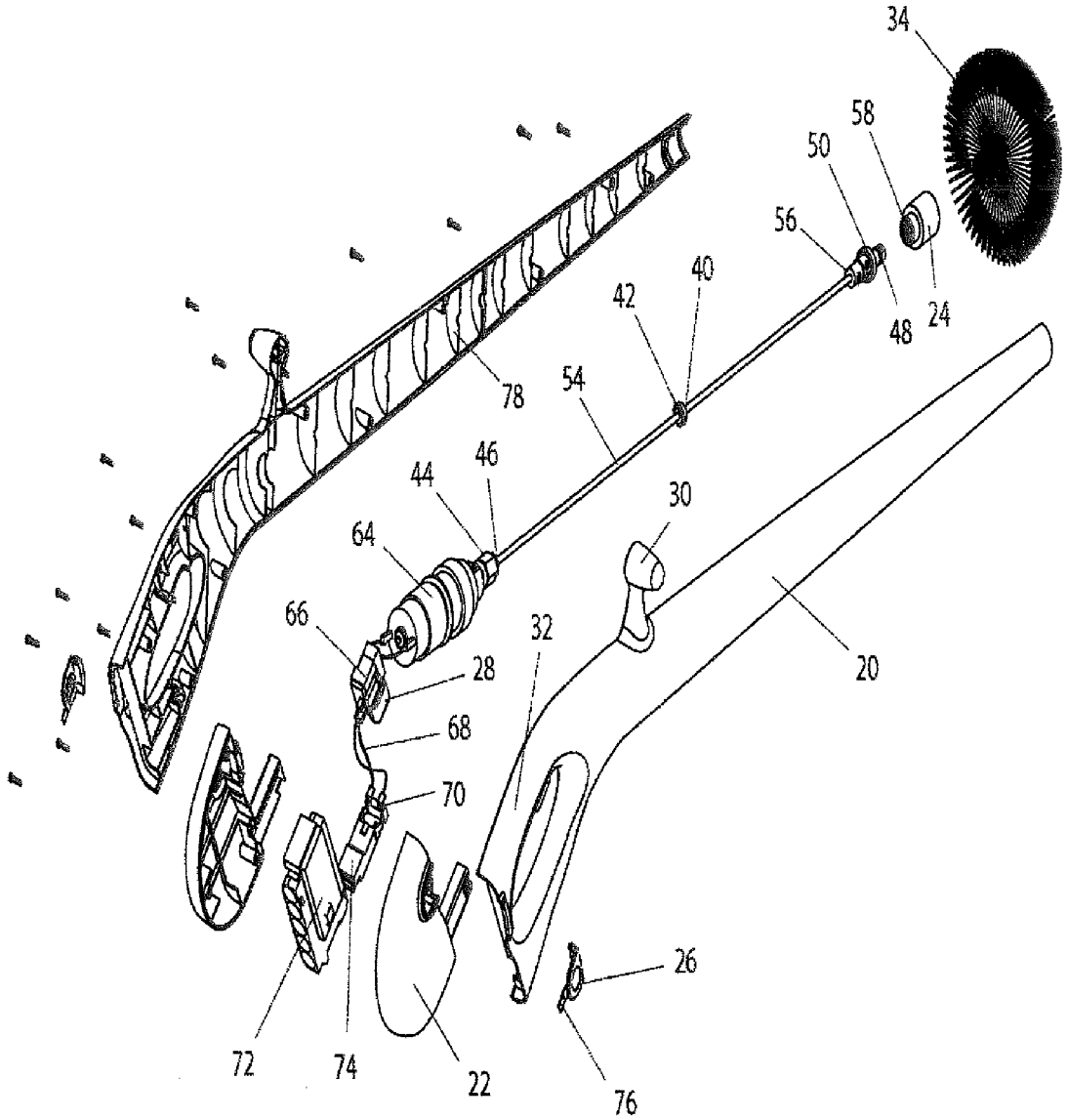
FIG. 10 is a perspective exploded view demonstrating components of one embodiment of present invention.

As generally understood, described herein and the present invention relates to an improved cleaning device. In the embodiments of FIGS. 1-10, assembly 200 includes a main body 20 having a first, or handle end including a handle portion 32 and actuator 28 a battery compartment 22 and a battery compartment closure 26. Body 20 further includes a second and whereby a cleaner head 34 is mounted upon a cleaner head support 24. In one embodiment, cleaner head 34 is a cleaner brush. However, additional cleaner heads are contemplated as being used with the present invention including a cleaner mop 36, a cleaner buffer 38, and other similar cleaner head configurations. In one embodiment, a support brace 30 is provided with main body 20. It is contemplated that in use a user will grasp handle portion 32 with one hand and support brace 30 with the other hand in using the device of the present invention.

Figure 11:
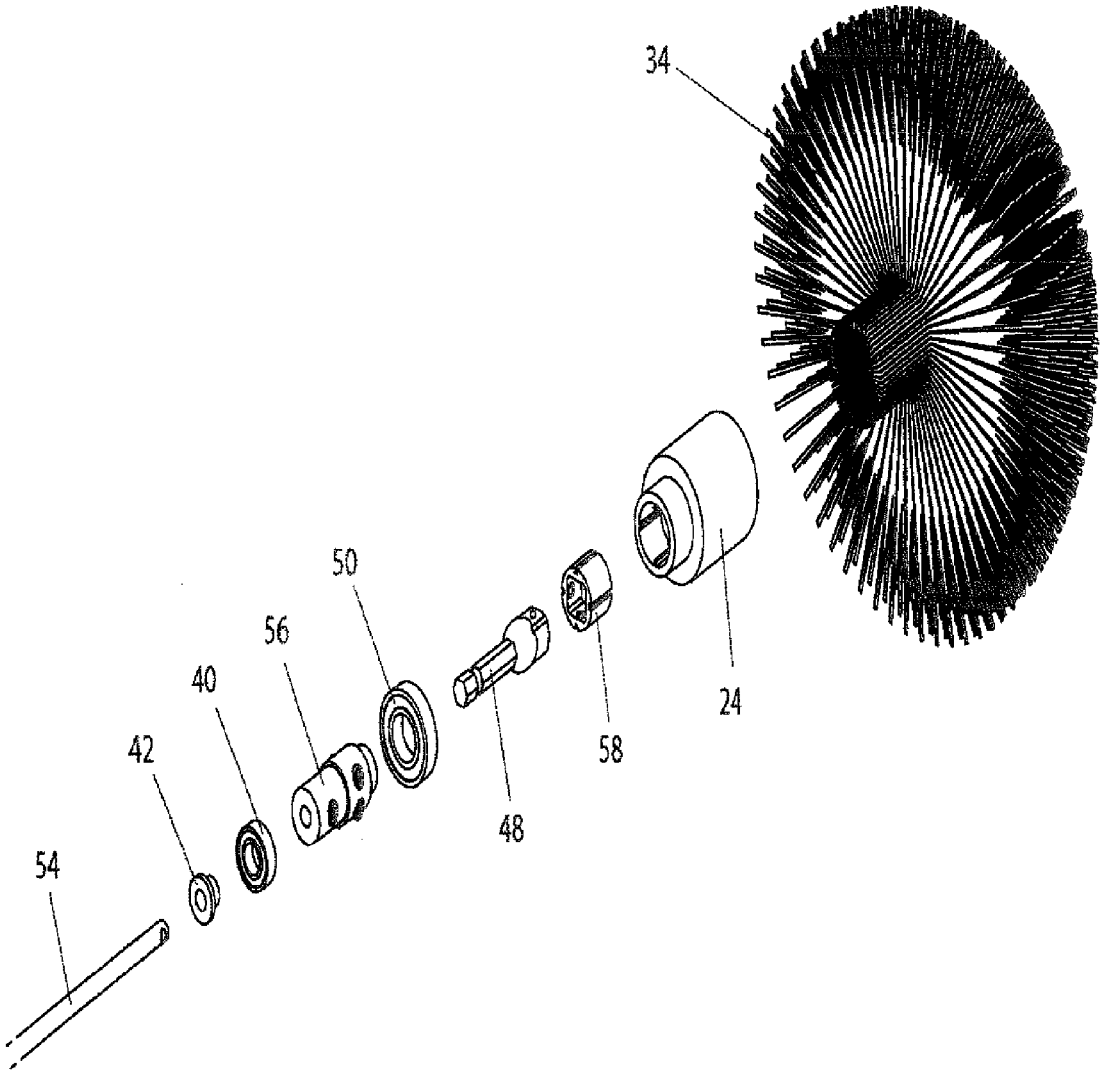
FIG. 11 is a detail exploded view demonstrating components of the cleaner head mechanism of the embodiment of FIG. 10.
Figure 12:
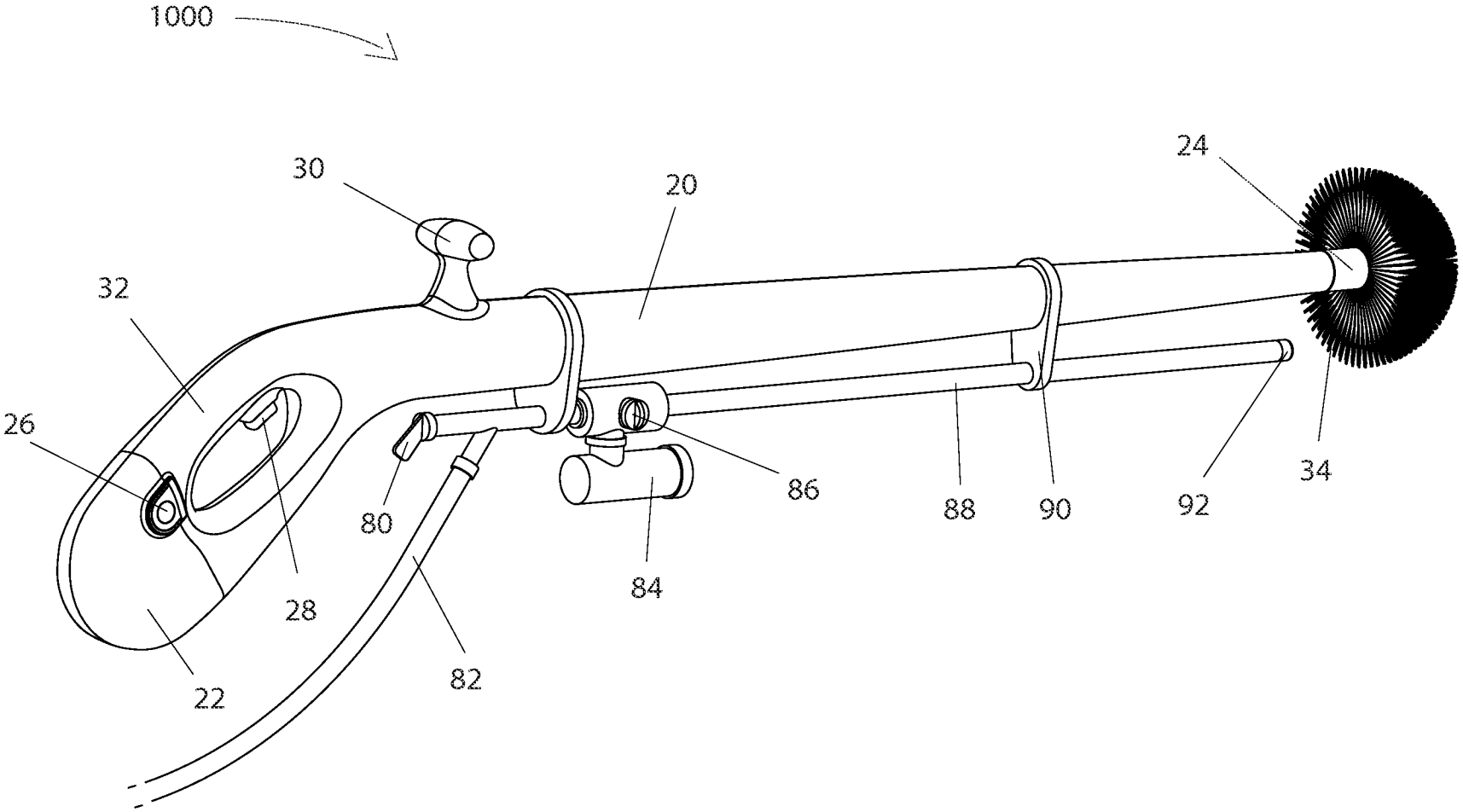
FIG. 12 is a perspective view of one embodiment of the present invention.
Figure 13:
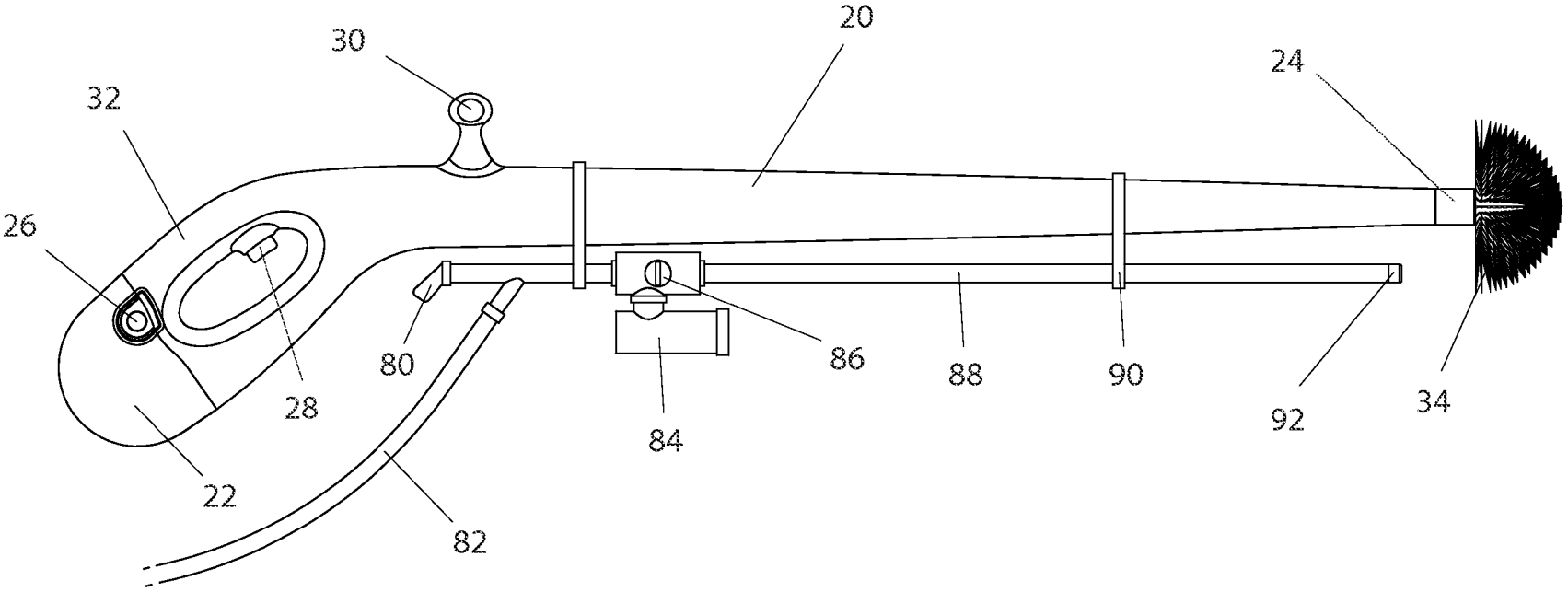
FIG. 13 is a side view of one embodiment of the present invention.
Figure 14:
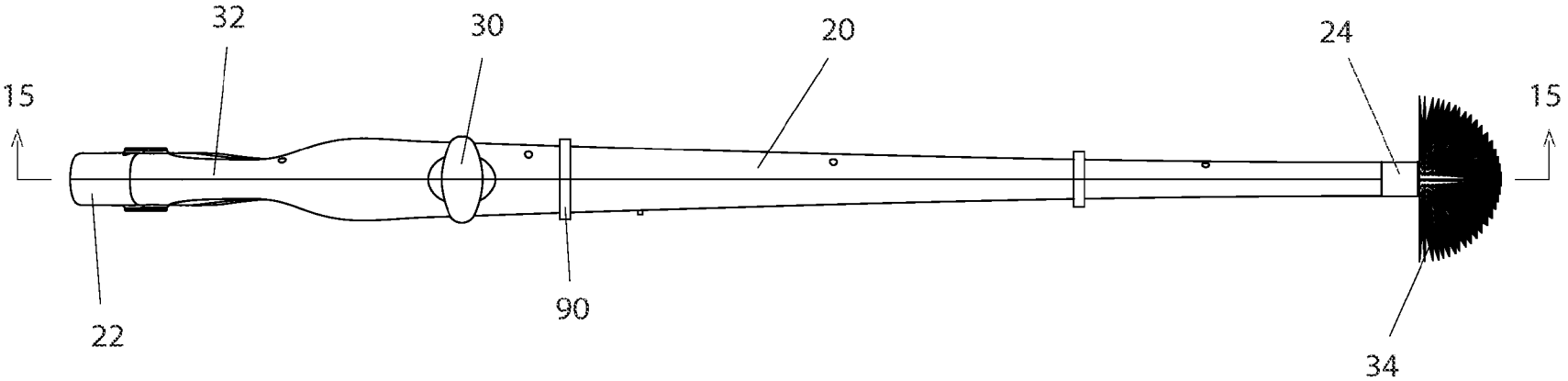
FIG. 14 is a top view of one embodiment of the present invention.
Figure 15:
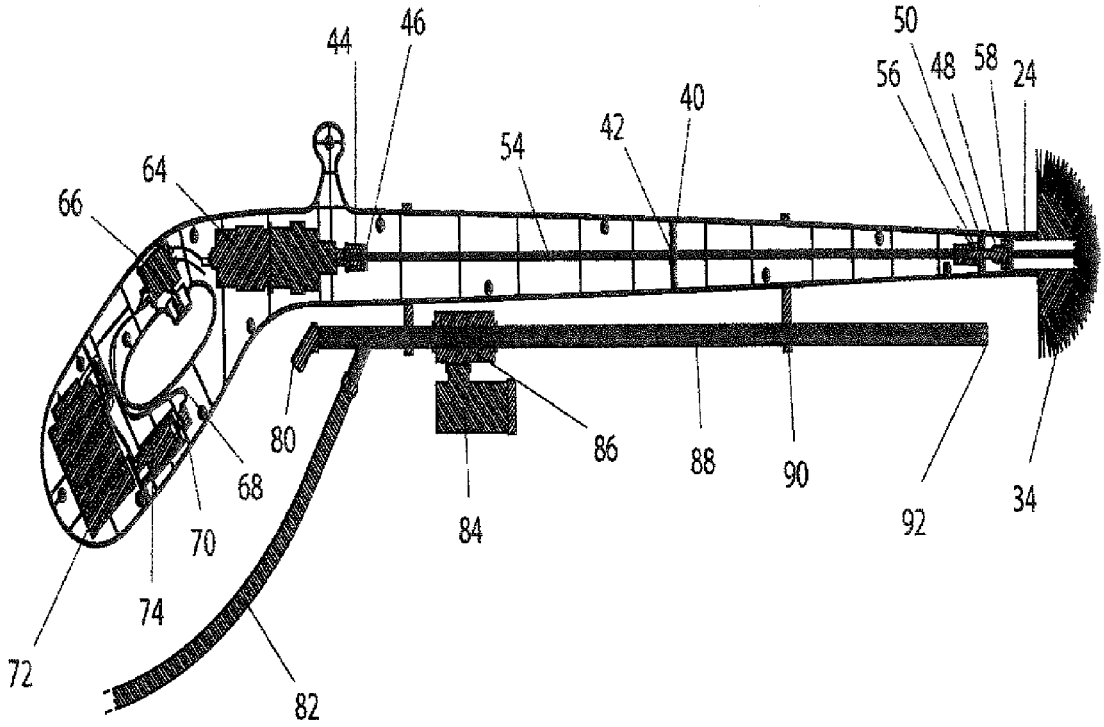
FIG. 15 is a side cross-sectional view of one embodiment of the present invention.

As demonstrated in FIGS. 6 through 9, a rotational motor nut 44 is operatively associated with motor 64 and is configured to interact with shaft nut 46. Shaft 54 extends from motor 64 towards the cleaner head. Shaft 54 contacts fitting 56 which is operatively associated with adapter 48 and attachment connector 58 that ultimately provides rotational movement on cleaner head 34 or other cleaner heads attached to the assembly. Motor 64 is actuated by actuator 28 associated with electrical actuator assembly 66. Batteries 72 are connected with stem connector 74 and electrical connectors 70 serve to supply power to electrical actuator assembly 66 and ultimately to motor 64. Battery compartment 22 is closed by battery assembly closure 26 having a closure pin 76 configured therewith. Although a particular closure is demonstrated in the figures, battery compartment 22 is contemplated as being opened and subsequently closed through any acceptable means. As demonstrated in the embodiment of FIG. 11 shaft 54 is configured with a bearing spacer 42 that connects to middle bearing 40. Middle bearing 40 is associated with fitting 56 and front bearing 50. The front bearing 50 is configured to interact with adapter 48 which contacts shaft nut 46 ultimately turning head support 24.

In the embodiments of cleaner assembly 1000 as shown in FIGS. 12 through 17, a water hose 82 is provided whereby hose 82 supplies water that is mixed with soap provided in soap reservoir 84. Although the reservoir 84 is designated for soap, any cleaning solution or liquid is contemplated use therein. A flow valve 86 is provided to selectively adjust the mixture of water supplied by water hose 82 and soap in soap reservoir 84. A water control valve 80 is provided to regulate only the amount of water entering the system. The selected amounts of water and/or soap proceeds through dispenser shaft 88 and ultimately exits the device through dispenser shaft outlet 92. In one embodiment, dispenser shaft 88 is secured with dispenser shaft bracket 90.

Figure 16:
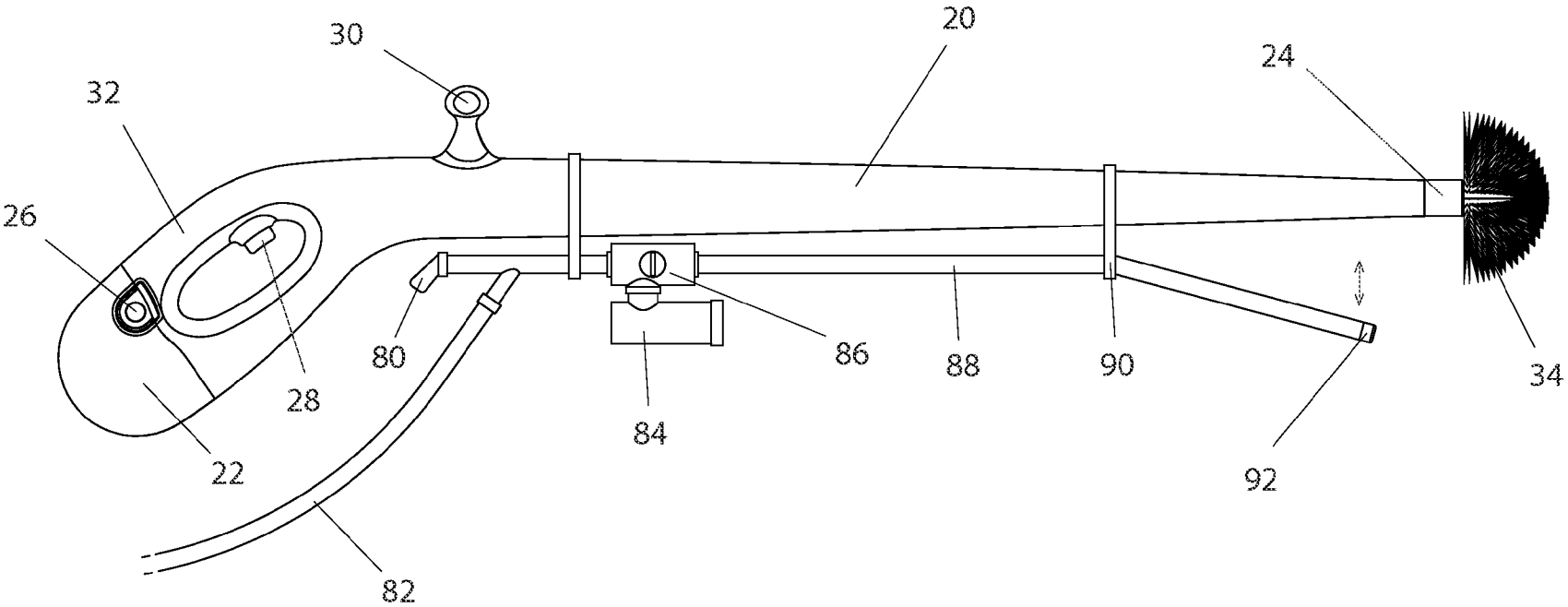
FIG. 16 is a side view of one embodiment of the present invention.
Figure 17:
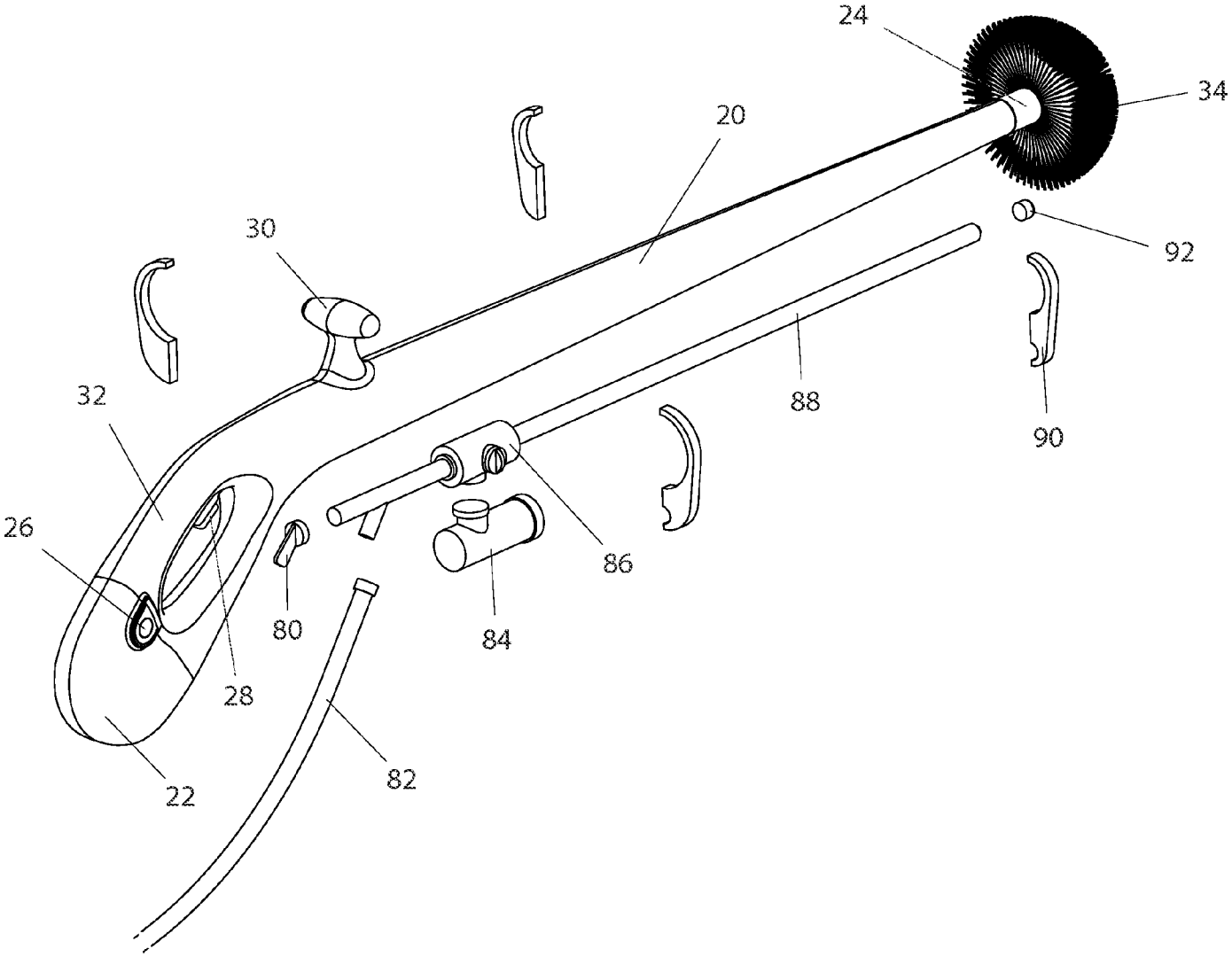
FIG. 17 is a perspective partially separated view demonstrating components of one embodiment of the present invention.

In an embodiment demonstrated in FIG. 16, dispenser shaft outlet 92 is movable and adjustable in order to direct solution that is exiting the outlet.

In using the device demonstrated in FIGS. 1 through 10, a user will grasp the assembly with one hand positioned within the cavity of handle portion 32 and a second hand grasping a support brace 30. Actuator 28 is provided as a spring-loaded trigger whereby pressure on the trigger when grasped by a user actuates motor 64 and ultimately rotates cleaner head 34 or any other cleaner head attached to the assembly. The user will then move cleaner head 34 in directions as desired in order to clean particular surfaces and/or areas.

In the embodiment demonstrated in FIGS. 12 through 17, a user will utilize water inlet 82 and or solution chamber 84 adjusting appropriately supplied valves to provide desired water and/or water mixed with cleaning solution. The cleaning solution will exit through the dispenser shaft outlet 92 which is positioned near cleaner head support 24. A user will provide the appropriate cleaning liquid and utilize cleaner head 34 or other incorporated cleaner head in order to clean a desired surface.

Figure 18:
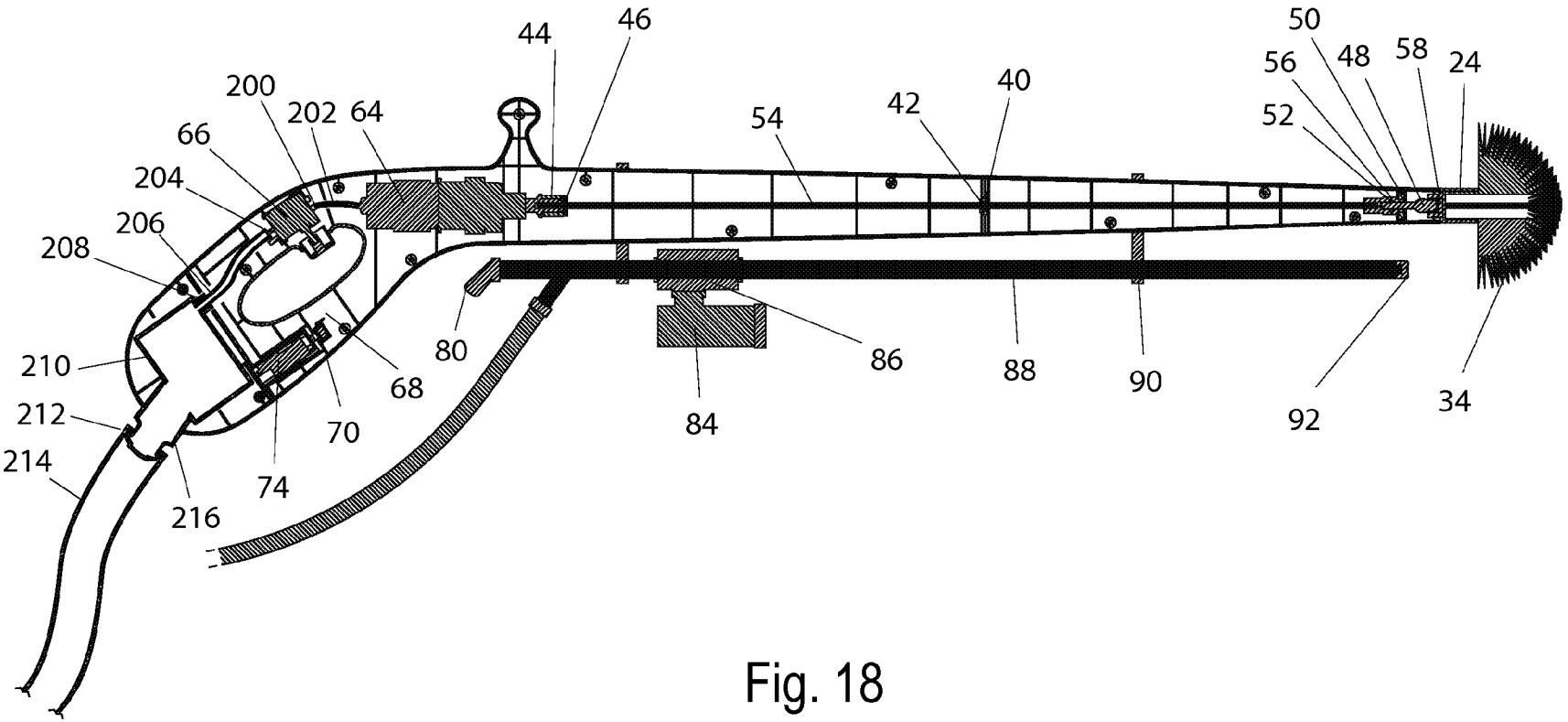
FIG. 18 is a side cross-section view demonstrating components of one embodiment of the present invention.
Figure 19:
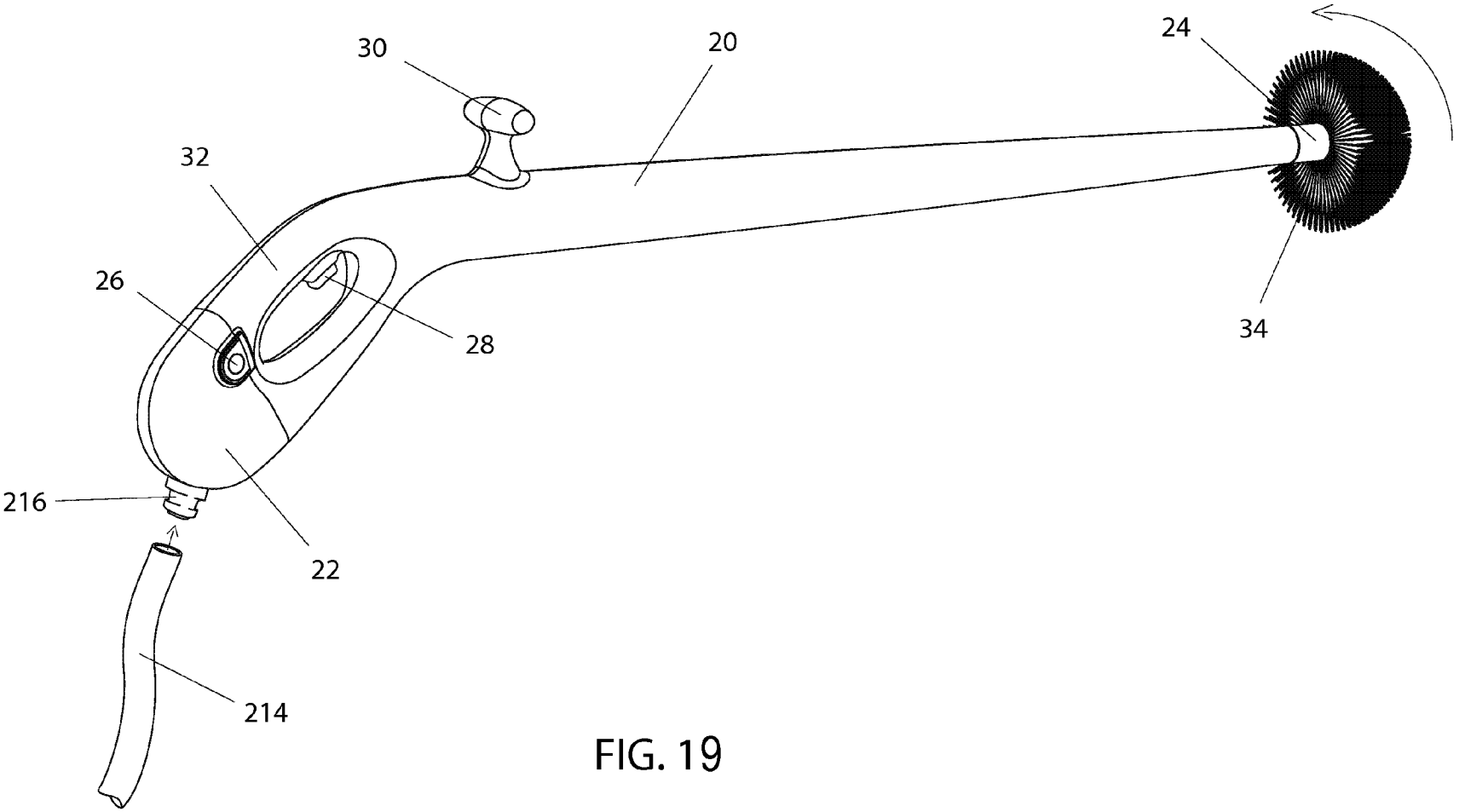
FIG. 19 is a perspective view demonstrating components of one embodiment of the present invention.

In one embodiment, as shown in FIGS. 18 and 19 a pneumatic hose 214 having an outlet 212 is connected to pneumatic inlet 216. In this embodiment, the invention is powered pneumatically. Pressurized air container 210 receives inlet air from pneumatic inlet 216 and directs air through trigger hose 206 that is connected to container 210 at connector 208. Connector 204 connects hose 206 to electrical actuator assembly 66. Second connector 200 attaches motor hose 202 and connects to motor 64. Air exits the device through the interior and ultimately through brush head 34.

While the invention has been described in its preferred form or embodiment with some degree of particularity, it is understood that this description has been given only by way of example and that numerous changes in the details of construction, fabrication, and use, including the combination and arrangement of parts, may be made without departing from the spirit and scope of the invention.

I claim:

1. A cleaner assembly comprising;

a main body including:

a first end comprising a handle portion;

a pneumatic motor contained within said main body; and a rotational shaft within said main body;

an actuator operatively associated with said motor;

a cleaner head removably attached to said rotational shaft; and a solution delivery assembly entirely external said main body, said solution delivery assembly including:

a dispenser shaft having a dispenser shaft outlet moveable relative said dispenser shaft; and a solution reservoir configured to deliver a liquid through said dispenser shaft and out through said dispenser shaft outlet;

wherein said rotational shaft is operatively associated with said motor and with a rotational cleaner head support; and wherein said shaft includes a middle bearing and middle bearing spacer positioned between said motor and said cleaner head support along the length of said shaft.

2. The cleaner assembly of claim 1 wherein said shaft is a shaft assembly that includes two or more shafts acting in concert.

3. The cleaner assembly of claim 1 wherein said solution delivery assembly further comprises a water inlet having a water inlet control valve.

4. The cleaner assembly of claim 1 wherein said solution delivery assembly further comprises a solution reservoir control valve.

5. The cleaner assembly of claim 1 wherein said solution delivery assembly further comprises a water inlet having a water inlet control valve and a solution reservoir assembly having a solution reservoir control valve.

* * * * *